US008321982B2

(12) United States Patent
Park et al.

(10) Patent No.: US 8,321,982 B2
(45) Date of Patent: Dec. 4, 2012

(54) OPERATING METHOD OF THE LAUNDRY MACHINE

(75) Inventors: Seog Kyu Park, Changwon-si (KR); Youn Dong Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/629,299

(22) PCT Filed: Mar. 24, 2006

(86) PCT No.: PCT/KR2006/001082

§ 371 (c)(1),
(2), (4) Date: Mar. 10, 2008

(87) PCT Pub. No.: WO2006/101365

PCT Pub. Date: Sep. 28, 2006

(65) Prior Publication Data

US 2008/0271754 A1 Nov. 6, 2008

(30) Foreign Application Priority Data

Mar. 25, 2005 (KR) ..... 10-2005-0025129
Mar. 25, 2005 (KR) ..... 10-2005-0025130
Mar. 25, 2005 (KR) ..... 10-2005-0025132

(51) Int. Cl.
*B08B 7/04* (2006.01)

(52) U.S. Cl. ..... 8/149.3; 8/149.1; 8/149.2; 8/158; 68/3 R; 68/5 R; 68/12.15; 68/12.21

(58) Field of Classification Search ..... 8/149.3, 8/158, 149.1, 149.2; 68/5 C, 5 R, 12.15, 68/15, 3 R, 12.21
See application file for complete search history.

(56) References Cited

U.S. PATENT DOCUMENTS 3,254,513 A * 6/1966 Gosnell ..... 68/12.08
3,911,943 A * 10/1975 Athey et al. ..... 137/341
4,058,975 A * 11/1977 Gilbert et al. ..... 60/39.281
7,614,106 B2 * 11/2009 Oh et al. ..... 8/158
2004/0187527 A1 9/2004 Kim et al.
2004/0244432 A1 12/2004 Kim et al.
2004/0255391 A1 * 12/2004 Kim et al. ..... 8/149.3
2005/0034490 A1 * 2/2005 Oh et al. ..... 68/5 C

FOREIGN PATENT DOCUMENTS

CN 1580353 A 2/2005
KR 10-2004-0085508 10/2004
KR 1020040085507 A 10/2004

* cited by examiner

*Primary Examiner* — Michael Barr
*Assistant Examiner* — Benjamin Osterhout
(74) *Attorney, Agent, or Firm* — McKenna Long & Aldridge LLP

(57) ABSTRACT

A method of operating a washing machine, by which a steam generator is disclosed, laundry and the washing machine itself can be safely protected in a manner that an error occurrence of the washing machine is accurately detected and by which a following cycle such as a washing cycle, a drying cycle and the like can be effectively performed despite the failure of the washing machine. The present invention includes a step (a) of supplying water to a steam generator, a step (b) of supplying steam into a drum by generating heat from a heater of the steam generator, and a step (c) of detecting abnormality of the washing machine while the step (a) or (b) is carried out.

20 Claims, 9 Drawing Sheets

OPERATING METHOD OF THE LAUNDRY MACHINE

This application claims priority to International application No. PCT/KR2006/001082 filed on Mar. 24, 2006, Korean Application No. 10-2005-0025129 filed on Mar. 25, 2005, Korean Application No. 10-2005-0025130 filed on Mar. 25, 2005, and Korean Application No. 10-2005-0025132 filed on Mar. 25, 2005, all of which are incorporated by reference, as if fully set forth herein.

TECHNICAL FIELD

The present invention relates to a method of operating a laundry machine. Although the present invention is suitable for a wide scope of applications, it is particularly suitable for performing washing using steam.

BACKGROUND ART

Generally, a laundry machine is classified into a pulsator washing machine having an upright drum and a drum type washing machine having a drum laid in a horizontal direction. And, a laundry machine includes a washing machine and a dryer for drying. Moreover, a washer and dryer provided with a drying function belongs a category of the washing device.

In this case, since a drum of the drum type washing machine is laid in a horizontal direction, laundry accommodated within the drum is washed by a falling system.

FIG. 1 and FIG. 2 schematically show a general drum type washing machine according to a related art.

Referring to FIG. 1 and FIG. 2, a drum type washing machine according to a related art includes a body 10, a tub 20 provided within the body 10, a drum rotatably provided within the tub 20 and a driving means for driving the drum 30.

In this case, an entrance 11 for inputting laundry is provided to a front side of the body 10 and a door 40 opening/closing the entrance is provided around the entrance 11.

Besides, a gasket 50 is provided to an inner circumference of the entrance 11 to seal a gap in between the door 40 and the entrance 11.

And, a damper 21 is provided to both lower sides of an outer circumference of the tub 20 to support the tub 20 within the body 10.

Moreover, the driving means includes a drive motor 71 driving the drum 30 and a belt 72 connected to drive a drive force of the drive rotor 71 to the drum 30.

Yet, in the above-explained related art washing machine, water is excessively and unnecessarily consumed in washing laundry that is small and/or less-filthy. In doing so, since the corresponding washing takes the same time required for a general washing course, electricity is unnecessarily consumed as well.

In particular, a laundry soaking prior to performing a washing process is more effective in enhancing washing performance but needs a considerable quantity of water for the laundry soaking. So, the laundry soaking is skipped in a general washing course, whereby it is difficult to obtain optimal washing performance.

Besides, a washing course of the related art washing machine does not include a sterilizing step for sterilizing laundry in addition.

Lately, there is a washing machine configured to have a water heater 60 provided within the tub 20, as shown in the attached drawings to enable a crumb-up washing. Yet, since sterilization of laundry is achieved by a crumb-up course only, it is not preferable that water and power consumptions for the crumb-up course are increased.

So, many efforts have been made to develop and research a new washing device capable of enhancing its washing performance with less water and power consumptions and providing a sterilization function in a manner of spraying high-temperature steam into its drum.

However, in theses related art washing machines provided with the steam spray function may be troubled with safety problems in case of malfunction occurrence. In particular, if there occur a malfunction of a steam generator generating to spray steam, an error in an element that supplies water to the steam generator or drum and the like, damage can be caused to the laundry by the high-temperature steam.

And, the malfunctions or errors of the steam generator or the element configuring the water may overheat the steam generator to reduce the safety of the washing machine itself, thereby triggering additional damages such as fire and the like.

Besides, the same problems are also applicable to a dryer provided with the steam generator.

DISCLOSURE OF INVENTION

Technical Problem

Accordingly, the present invention is directed to a method of operating a washing machine that substantially obviate one or more of the problems due to limitations and disadvantages of the related art.

An object of the present invention is to provide a method of operating a washing machine, by which a steam generator, laundry and the washing machine itself can be safely protected in a manner that an error occurrence of the washing machine is accurately detected.

Another object of the present invention is to provide a method of operating a washing machine, by which a following cycle such as a washing cycle, a drying cycle and the like can be effectively performed despite the failure of the washing machine.

Technical Solution

To achieve these and other advantages and in accordance with the purpose of the present invention, as embodied and broadly described, a method of operating a washing machine according to the present invention includes a step (a) of supplying water to a steam generator, a step (b) of supplying steam into a drum by generating heat from a heater of the steam generator, and a step (c) of detecting abnormality of the washing machine while the step (a) or b) is carried out.

In this case, the step (c) is a step of detecting the abnormality of the steam generator. In particular, the abnormality of the steam generator is a heat generation failure or overheat of the heater of the steam generator.

Preferably, if a temperature variation within a tub is equal to or smaller than a setup value for a predetermined time, the heat generation failure of the heater is detected. Preferably, if an internal temperature of the steam generator is equal to or greater than the setup value, the overheat of the heater is detected.

The abnormality of the steam generator may correspond to the abnormality of a steam temperature sensor sensing an internal temperature of the steam generator. In this case, if a temperature variation within the tub for a predetermined time exceeds a first setup value and if a temperature variation measured by the steam temperature sensor is equal to or smaller than a second setup value, it is preferable that the abnormality of the steam temperature sensor is detected.

Meanwhile, the step (c) may correspond to a step of detecting the abnormality of water supply to the steam generator. Preferably, the abnormality of the water supply to the steam generator is detected by a water level variation of water supplied into the steam generator. In this case, the abnormality of the water supply to the steam generator corresponds to a shortage of the water supply to the steam generator or an excessiveness of the water supply to the steam generator.

Preferably, if the water supplied into the steam generator is not detected equal to or greater than a first water level after a predetermined time passes from a timing point of initiating the water supply to the steam generator, the shortage of the water supply is detected. Preferably, if the water supplied into the steam generator is not detected equal to or smaller than a second water level after a predetermined time passes from a timing point of initiating the water supply to the steam generator, the excessiveness of the water supply is detected.

To achieve the technical task, the method can further include a step (d) of supplying water into a tub and circulating the water into the drum using a circulation pump.

In this case, the step (d) is preferably carried out together with the steps (a) and (b) substantially and simultaneously. More preferably, the step (c) corresponds to a step of detecting the abnormality of the circulated water. Namely, if the water is circulated and if the steam is supplied, the water circulation abnormality is detected.

If a water level variation within the tub for a predetermined time is equal to or smaller than a preset value, the abnormality of the circulated water can be detected. Namely, if the water is circulated to supply the water to a laundry, a water level of the water should be reduced. If a variation of the reduction is small, it can be regarded that the water circulation is not properly performed.

On the other hand, if the water level variation exceeds the preset value, it is preferable that the steps (a), (b) and (c) are repeatedly carried out until the internal temperature of the tub reaches a target temperature (T).

Preferably, the method further includes a step of stopping a power supply and a water supply to the steam generator if the abnormality of the washing machine is detected. Preferably, the method further includes a step of entering a normal washing mode.

In this case, the normal washing node includes the steps of supplying the water into a tub up to a setup level and rotating the drum clockwise and counterclockwise for a setup time. And, the normal washing mode can further include the step of heating the water using a water heater until an internal temperature of the tub reaches a setup temperature.

It is to be understood that both the foregoing general description and the following detailed description are exemplary and explanatory and are intended to provide further explanation of the invention as claimed.

Advantageous Effects

As mentioned in the foregoing description, according to the present invention, steam is sprayed into a drum in washing to provide a high-temperature ambience within the drum, whereby a washing cycle of laundry can be more effectively performed with less water and power consumptions.

And, the present invention prevents damage, which is attributed to a malfunction of a washing machine due to steam spray, from being caused to a laundry, a steam generator or a washing machine, thereby enhancing safety and reliability of the washing machine.

In particular, the washing method of the present invention can prevent damage from being caused to laundry within a drum in a manner that a general washing mode is entered by stopping a steam supply in case of a failure of a water circulation system including a circulation pump.

And, by detecting abnormality of a supply system supplying water to a steam generator and by entering a normal washing node on stopping the steam generator in case of abnormality occurrence, the present invention prevents damage from being caused to the steam generator and keeps performing washing without deactivating a washing machine.

Moreover, by accurately detecting abnormality of steam generation associated elements such as a steam heater of a steam generator, a steam side temperature sensor, a tub side temperature sensor and the like and by entering a normal washing mode on stopping the steam generator in case of abnormality occurrence, the present invention prevents damage from being caused to the steam generator and keeps performing washing without deactivating a washing machine.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

BEST MODE FOR CARRYING OUT THE INVENTION

Reference will now be made in detail to a method of operating a washing machine according to the preferred embodiments of the present invention, examples of which are illustrated in the accompanying drawings.

Figure 1:
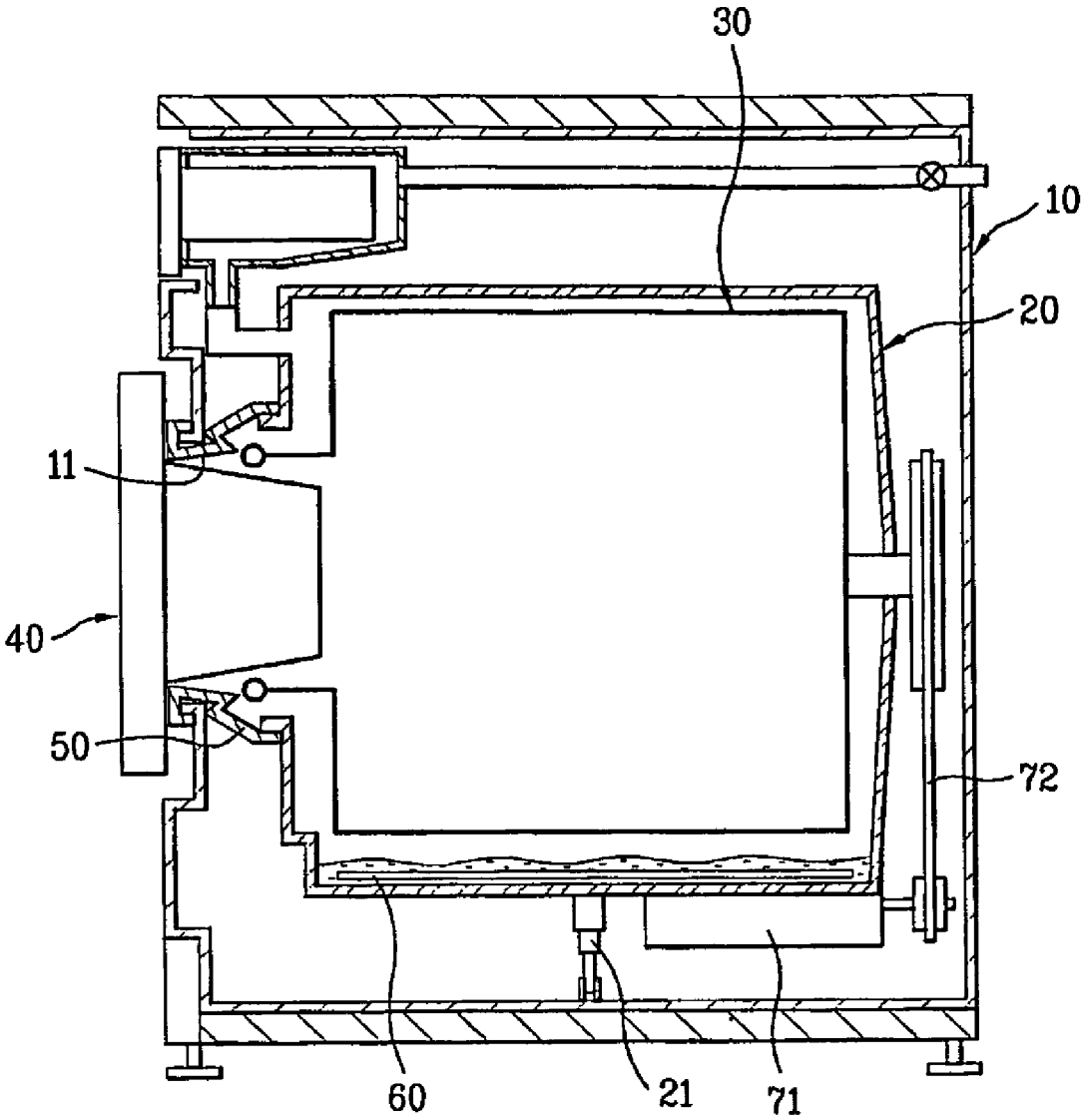
FIG. 1 is a side cross-sectional diagram of a general drum type washing machine according to a related art.
Figure 2:
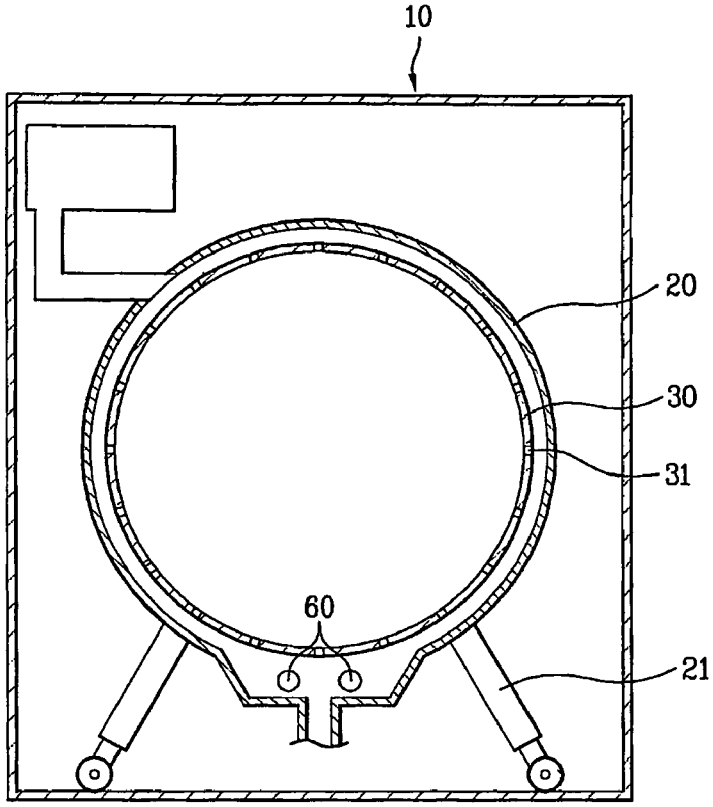
FIG. 2 is a front cross-sectional diagram of a general drum type washing machine according to a related art.
Figure 3:
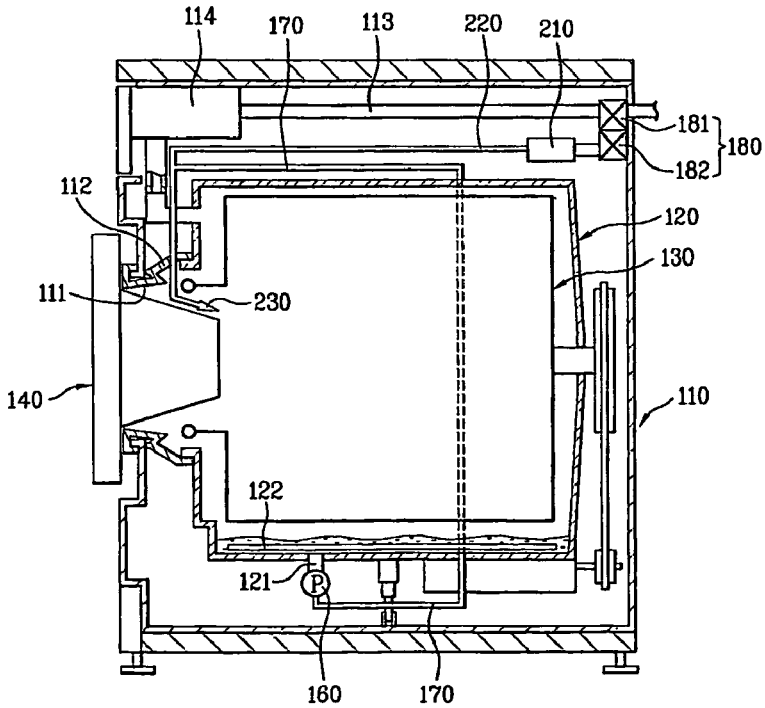
FIG. 3 is a side cross-sectional diagram of a washing machine according to the present invention.
Figure 4:
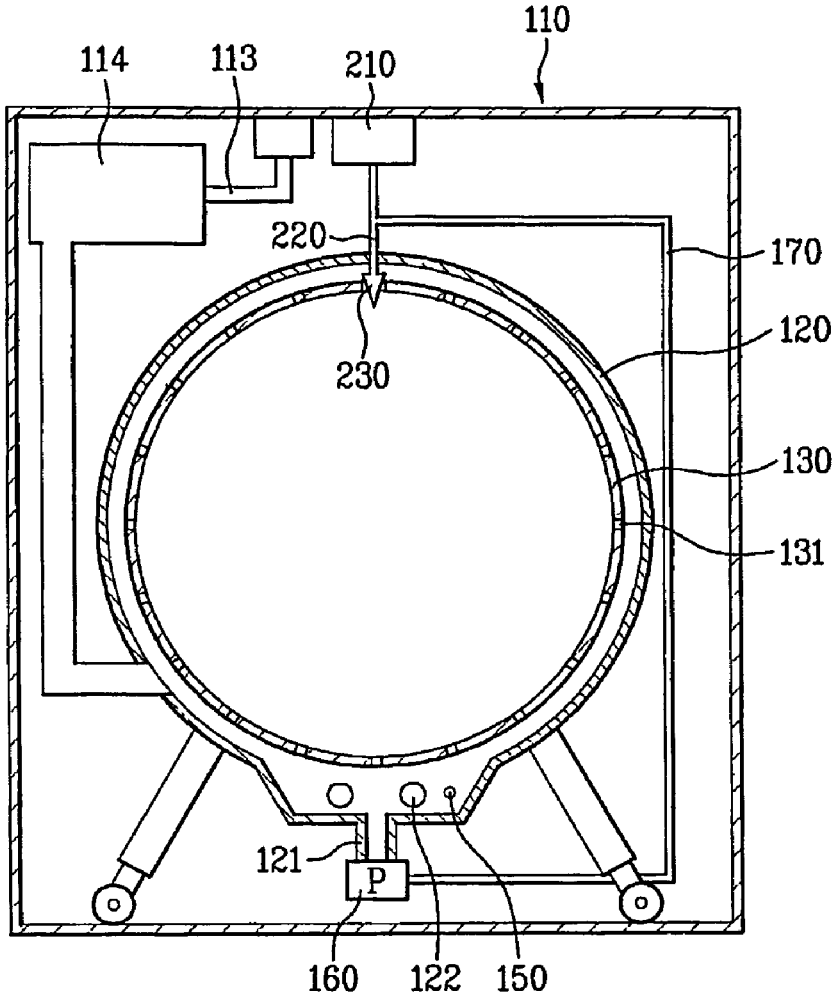
FIG. 4 is a front cross-sectional diagram of a washing machine according to the present invention.

Referring to FIG. 3 and FIG. 4, a washing machine according to the present invention includes a body 110, a tub 120, a drum 130, a steam supply part, a temperature sensor 150, a circulation pump 160, a circulation passage 170 and a water level sensor (not show in the drawings) sensing a water level within the tub. And, a drum type washing machine is taken as an embodiment of the washing machine according to the present invention.

In this case, the body 110 configures an exterior of the drum type washing machine. And, an entrance 11 is provided to a front side of the body 110.

A door 140 is assembled to a part of the body 110 around the entrance 111 to open/close the entrance 111. And, a gasket 112 is provided to an inner circumference of the entrance 111 to seal a gap in between the door 140 and the entrance 111.

A water supply pipe 113 is provided to the body 110 to supply water into the tub 120 and a detergent box 114 is provided on a passage of the water supply pipe 113.

Moreover, the tub 120 lies in a supported state within the body 110.

In this case, a drain passage 121 is connected to a lower end of the tub 120 to drain water.

A water heater 122 is further provided to the lower end part of the tub 120 to heat water supplied into the tub 120.

The drum 130 is rotatably installed within the tub 120 to have its opening side oppose the entrance 111 of the body 110.

A multitude of perforated holes 131 are formed on a circumference of the drum 130 to introduce water and steam into the drum 130 to be supplied to the tub 120.

And, at least one steam supply part is configured to supply a predetermined quantity of steam into the tub 120 and/or the drum 130.

The circulation pump 160 is provided on the drain passage 121 connected to the tub 120 to operate to pump and circulate the water supplied into the tub 120.

The circulation passage 170 is connected to the circulation pump 160 and is a passage that guides a circulation flow of the water pumped by the circulation pump 160.

In this case, it is preferable that an end portion of the circulation passage 170, from which water is discharged, passes through the gasket 112 to face an inner wall side of the drum 13. The end portion of the circulation passage 170, as shown in the drawings, can be connected to a steam supply pipe 220. Alternatively, the end portion of the circulation passage 170 can be connected to an inside of the drum.

The temperature sensor 150 is provided one part within the tub 120 to play a role in sensing a temperature within the tub 120. The temperature sensed by the temperature sensor 150 is usable for an operation of the steam supply part and a control of the water heater 122.

Meanwhile, an unexplained reference number '180' indicates a water supply valve assembly 180 selectively supplying water supplied from outside to the detergent box 114 and the steam supply part. And, an unexplained reference number '181' indicates a water supply valve controlling a water supply into the tub 120 via the detergent box 114. And, an unexplained reference number '182' indicates a steam water supply valve controlling a water supply to the steam supply part.

The steam supply part is configured to heat water into steam with hot air and to supply the steam into the tub 120 and/or the drum 130. And, the steam supply part includes a steam generator (SG) 210 generating steam from water with high-temperature air, a steam supply pipe 220 in which the steam generated by the steam generator 210 flows, and a spray nozzle 230 spraying the steam flowing through the steam supply pipe 220 into the tub 120 and/or drum 130.

The spray nozzle 230 is configured to have a nozzle shape to enable a smooth spray of the steam. Preferably, a tip of the spray nozzle 230 passes through the gasket 112 to face an inside of the drum 130.

Figure 5:
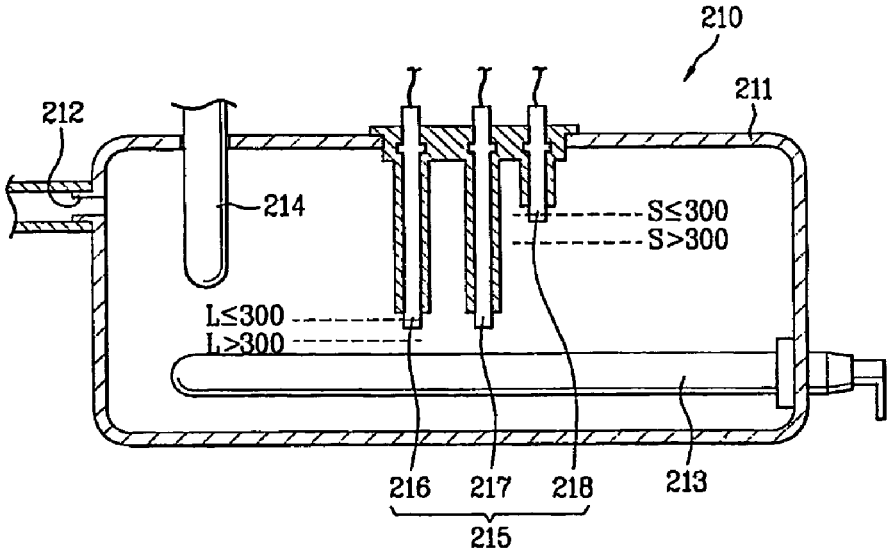
FIG. 5 is a front cross-sectional diagram of a steam generator of the washing machine of FIG. 3 according to one embodiment of the present invention.

A configuration and operation of the steam generator 210 according to one embodiment are explained in detail with reference to FIG. 5 as follows.

First of all, the steam generator 210 includes a case part 211, a steam heater 213, a steam side temperature sensor 214 and a water level sensor 215. In this case, the case part 211 can have a rectangular box shape configuring an exterior of the steam generator and a space for generating steam. An inlet 212 for supplying water into the case part 211 and an outlet (not shown in the drawing) for discharging the generated steam to communicate with an external space are provided to the case part 211.

The steam heater 213 is provided within the case part 211 to play a role in evaporating water stored within the case part 21 using heat generated from the steam heater 213. the steam heater 213 can be configured using Sheath heater or the like. A fuse (not shown in the drawing) is built in the steam heater 213 to protect the steam generator by cutting off a power supply in overheating.

The steam side temperature sensor 214 is electrically connected to a controller (not shown in the drawing) of the washing machine. And, the steam side temperature sensor 214 plays a role in sensing a temperature within the case part 211 when the steam heater 213 generates heat.

The water level sensor 215 is constructed with three electrodes including a common electrode 216, a long electrode 217 and a short electrode 218 to play a role in sensing a water level within the case part 211. The water level sensor 215 is electrically connected to a controller (not shown in the drawing) controlling an overall operation of the elements of the washing machine.

Each terminal of the common and long electrodes 216 and 217 is configured to be exposed at a height set to a minimum water level of water necessary for the steam generation. The short electrode 218 is formed relatively shorter than each of the common and long electrodes 216 and 217 so that its electrode is exposed at a height approximately set to a maximum water level necessary for the steam generation.

In this case, it is preferable that the height at which the terminal of each of the long and common electrodes 217 and 216 is exposed is set to a height enabling the steam heater 213 to be completely submerged under the water.

The controller (not shown in the drawing) of the washing machine is provided with an A/D (analog/digital) converter (ADC) (not shown in the drawing) converting a provided sensing value sensed by the water level sensor 215 to digital data. And, the controller performs an operation control of the steam water supply valve 182 of the water supply valve assembly 180 and a heat generation control of the steam heater 213 by comparing a digital data value (hereinafter called 'conversion value') converted by the A/D converter to a preset reference value.

For instance, before water supplied to the steam generator 210 reaches the long electrode 217, a conversion value (hereinafter named 'L') of the long electrode 217 exceeds 300 and a conversion value (hereinafter named 'S') of the short electrode 218 exceeds 300 as well.

If the water supplied to the steam generator 210 rises to touch the long electrode 217, 'L' is lowered below 300. If the supplied water keeps rising to touch the short electrode 218, 'S' is lowered below 300 as well.

So, if the S goes below 300, the controller (not shown in the drawing) detects a full water level, stops a water supply to the steam generator 210 and turns on the steam heater 213 to generate heat. If the L exceeds 300 after the heat generation, the controller detects an empty water level, stops the heat generation and re-initiates the water supply to the steam generator 210. In this case, as mentioned in the foregoing description, the water supply to the steam generator 210 is carried out by controlling the steam water supply valve 182 (see FIG. 3).

The steam generator 210 repeatedly carries out this water level detection according to the water level sensor 215 to supply steam into the drum by repeating the water supply and the switching of the steam heater 213.

A washing method using the above configured drum type washing machine according to one preferred embodiment of the present invention is explained with reference to flowcharts shown in FIG. 6 and FIG. 7 as follows.

Figure 6:
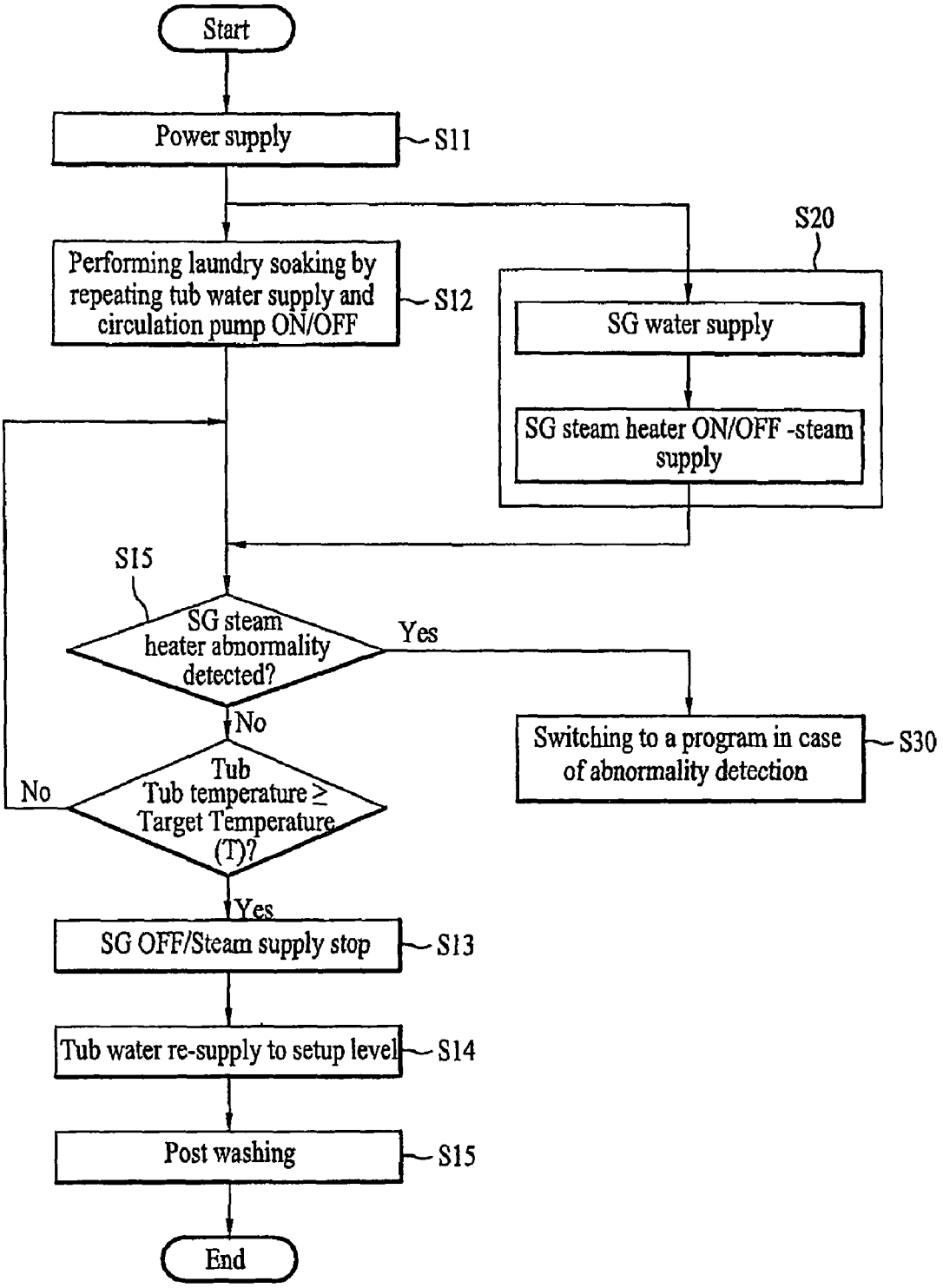
FIG. 6 is a flowchart of a method of operating a washing machine according to one embodiment of the present invention.

First of all, FIG. 6 schematically shows an overall process of a method of operating a washing machine according to the present invention. If a power is supplied to the washing machine (S11), the controller (not shown in the drawings) configuring the washing machine controls the water supply valve 181 of the water supply valve assembly 180 to supply water into the tub 120 up to a setup level. The controller drives the circulation pump 160 to circulate the water within the tub 120 to an upper side of the drum 130 via an outside of the tub and performs a laundry soaking by rotating the drum 130 simultaneously (S12).

In this case, the controller supplies a predetermined quantity of water into the steam generator 210 by controlling the steam water supply valve 182 of the water supply valve assembly 180. As mentioned in the foregoing description, by detecting the level of the water supplied into the steam generator 210 and by performing a heat generation control of the steam heater 213 and a control of the steam water supply valve 182, the controller supplies steam into the drum 130.

Thus, while the water re-supply into the tub, the drum rotation and the laundry soaking by the activated circulation pump 160 are in progress, the high-temperature steam is sprayed into the drum 130 through the steam supply part so that an internal ambience of the drum 130 can be controlled to maintain a temperature most effective in washing performance.

The laundry soaking step S12 and The steam supply step S20 via the steam generator 210 are carried out until the temperature sensed by the temperature sensor 150 reaches a target temperature T.

If the temperature sensed by the temperature sensor 150 reaches the target temperature T, the steam supply via the steam generator 210 is stopped (S13). A water supply is carried out up to a setup water level within the tub 120 by controlling the water supply valve 181 (S14). The drum 130 is then rotated clockwise and counterclockwise to perform a post-washing by a setup program (S15). In the nurse of performing the post-washing, water within the tub 120 can be heated at a prescribed temperature to perform a washing using the water heater 122 or a washing can be performed by driving the circulation pump 160 periodically to circulate water.

After completion of the post-washing, a selected cycle such as a rinsing cycle, a dewatering cycle and the like is carried out in sequence.

Meanwhile, while the laundry soaking and the steam supply are carried out, the controller detects abnormality of the steam generator (SG) 210 (S15). If the abnormality of the steam generator is discovered, it is switched to a program previously set for abnormality detection (S30).

Namely, while the water or steam is supplied to the steam generator, the abnormality of the washing machine, and more particularly, the abnormality of the steam generator is detected.

Figure 7:
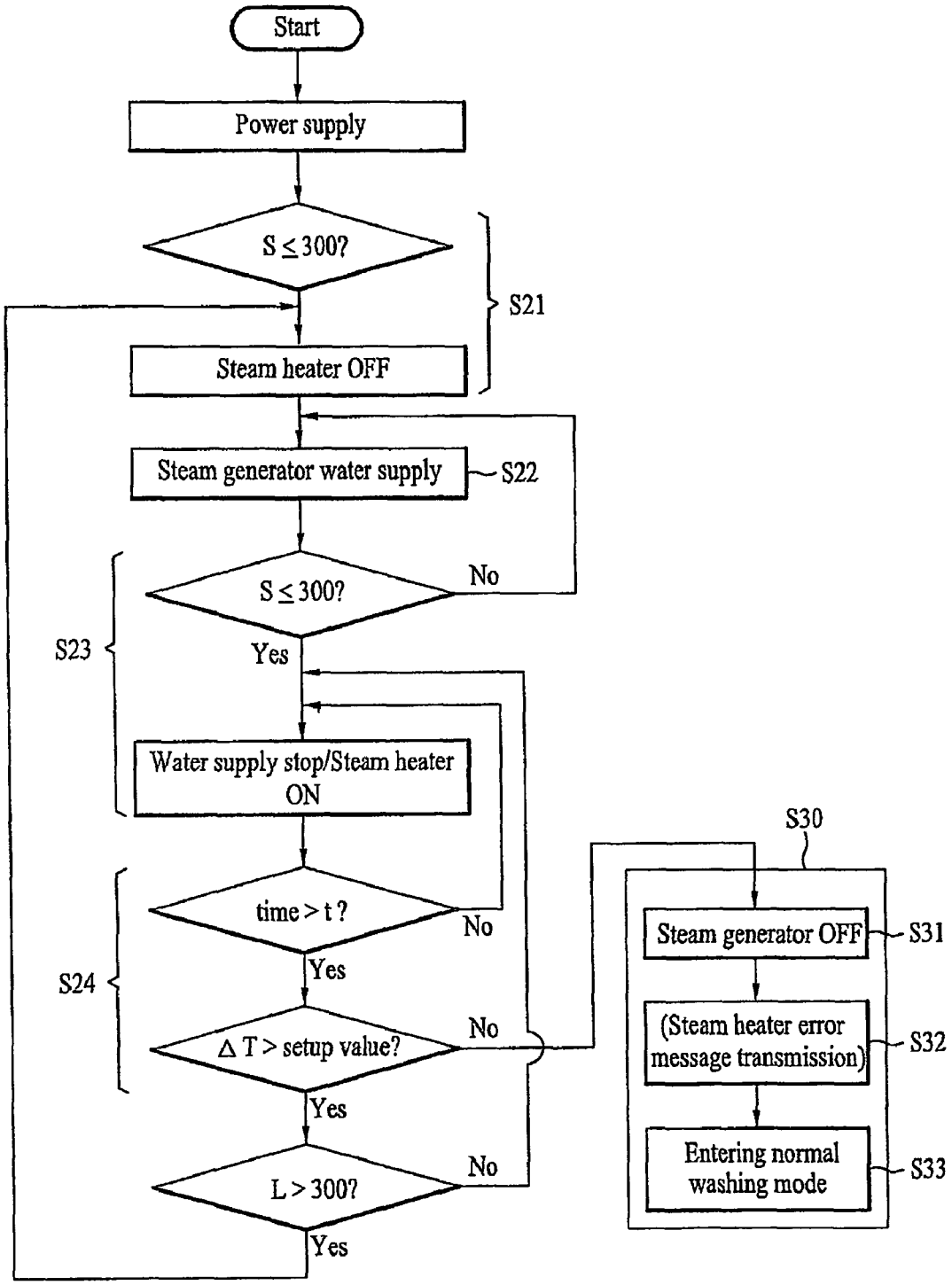
FIG. 7 is a flowchart of a method of detecting abnormality of a steam heater in the method of operating the washing machine in FIG. 6.

FIG. 7 shows a method of performing a washing by detecting an abnormality of a steam heater among the abnormalities of the steam generator (SG) 210 according to one embodiment.

Referring to FIG. 7, if a conversion value (S) of the short electrode 218 is greater than 300 by supplying a power, water is supplied to the steam generator 210 while a power is not applied to the steam heater 213 (S21, S22).

Subsequently, if the conversion value (S) of the short electrode 218 becomes equal to or smaller than 300, i.e., if a full water level is detected, the water supply is stopped and steam is supplied by supplying the power to the steam heater 213 to generate heat from the steam heater 213 (S23).

Thus, once the steam is generated by heating the water in the steam generator 210, a level of the water is gradually lowered. So, if a conversion value (L) of the long electrode 217 becomes greater than 300 due to the lowered water level within the steam generator 210, an empty water level is detected. The power of the steam heater 213 of the steam generator 210 is cut off (S21) and water is supplied into the steam generator 210 by turning on the steam water supply valve 182 again (S22).

The steam generator 210 keeps supplying the steam by repeating the above steps until an internal temperature of the drum 130 reaches a target temperature (T) (see FIG. 6).

Meanwhile, after a predetermined time (t) passes from a timing point of supplying the power to the steam heater 213 in the course of supplying the steam from the steam generator 210, a temperature change ($\Delta T$) sensed by the temperature sensor 150 of the tub 120 is compared to a preset value (S24). If the temperature change ($\Delta T$) is smaller than the preset value, it can be decided that the high-temperature steam is not substantially sprayed into the tub 120.

So, in this case, the controller (not shown in the drawing) decides that the steam heater 213 does not generate heat and then stops the water supply and the power supply to the steam generator 210 (S31). The controller externally transmits a steam heater error message through a display unit (not shown in the drawing), a warning sound generation and/or the like and then continues the washing by entering a normal washing mode.

Alternatively, in case of detecting the abnormality of the steam heater 213, the washing may proceed by entering the normal washing mode immediately without transmitting the steam heater error message externally. Yet, it is preferable to transmit this error message for the after-management such as A/S and the like.

While the steam generator is being driven 210, if a temperature change of the tub side temperature sensor 150 is equal to or greater than the preset value after a predetermined time (t) from a timing point of turning on the steam heater 213 and if a temperature change of the steam side temperature sensor 214 is equal to or lower than the preset value, it can be decided as the abnormality of the steam side temperature sensor 214.

In this case, it may be decided that the steam side temperature sensor 214 is unable to sense an internal temperature rise of the steam generator 210 although the steam is supplied into the tube owning to the normal heat generation from the steam heater 213. Hence, it can be decided as the abnormality of the steam side temperature sensor 214.

Thus, in case that the abnormality takes place in the steam side temperature sensor 214, although there is substantially no problem in the steam generation, it unable to accurately detect the excessive temperature rise of the steam heater 213, the heat generation failure of the steam heater 213 and the like. So, the safety of the steam generator can be interrupted.

So, in this case, it is preferable that the washing is carried out by completely stopping driving the steam generator and by entering the normal washing node.

The above-explained abnormality of the steam heater 213 or the steam side temperature sensor 214 can be attributed to a power supply failure, wire disconnection, malfunction, bad contact and the like.

Meanwhile, damage can be caused to the steam generator 210 in case that the steam heater 213 generates heat at the setup temperature or higher within a short time not because of the abnormality of the steam heater 213 or the steam side temperature sensor 214. So, in this case, it is preferable that the washing is carried out in a manner of cooling down the steam heater 213 by cutting off the power supplied to the steam heater 213 and by performing a water supply into the steam generator 210 for a pre-determined time.

Although the steam generator 210 is normally driven to normally supply the steam into the tub 120, f it is unable to accurately detect an internal temperature of the tub due to the abnormality occurrence of the tub side temperature sensor 150, the internal temperature of the tub is unable to reach the target temperature explained in FIG. 6. So, even if the internal temperature of the tub 120 substantially becomes equal to or greater than the target temperature, the steam supply keeps being performed via the steam generator 210.

Accordingly, in the present invention, while a predetermined time passes from a timing point of initiating the steam supply, the water level sensor 214 of the steam generator 210 normally detects the full water level and the empty water level and the steam side temperature sensor 214 senses a normal steam generating temperature range. Yet, if the temperature change of the tub side temperature sensor 150 is smaller than the preset value or the corresponding temperature measurement is not performed at all, it is decided as the abnormality of the temperature sensor 150 of the tub 120. So, the washing is carried out by stopping driving the steam generator 210 and by entering the normal washing mode.

Preferably, the washing is carried out without using the water heater 122.

The normal washing mode, which is entered in case of the abnormality occurrence, is a process of performing a washing cycle without supplying steam into the drum 130 like the washing cycle conducted by the conventional washing machine. For instance, like the aforesaid post-washing, laundry is washed in a manner of supplying water up to the setup level within the tub 120 and rotating the drum 130 clockwise and counterclockwise.

In this case, it is preferable that the washing is performed by heating water at a prescribed temperature using the water heater 122 except a case of the abnormality of the tub side temperature sensor 150.

Meanwhile, the washing machine according to the present embodiment may correspond to a dryer equipped with a steam generator. In case of this dryer, if abnormality of the steam generator take place, an operational method can be controller in a manner of continuing a subsequent drying cycle or terminating all cycle.

MODE FOR THE INVENTION

A method of operating a washing machine according to another embodiment of the present invention is explained in detail with reference to the attached drawings as follows.

Unlike the former embodiment of the present invention, the present embodiment is characterized in that abnormality of a washing machine corresponds to abnormality of water supply to a steam generator in particular. A configuration of the washing machine can be identical to that of the former embodiment, of which explanation is skipped in the following description.

Figure 8:
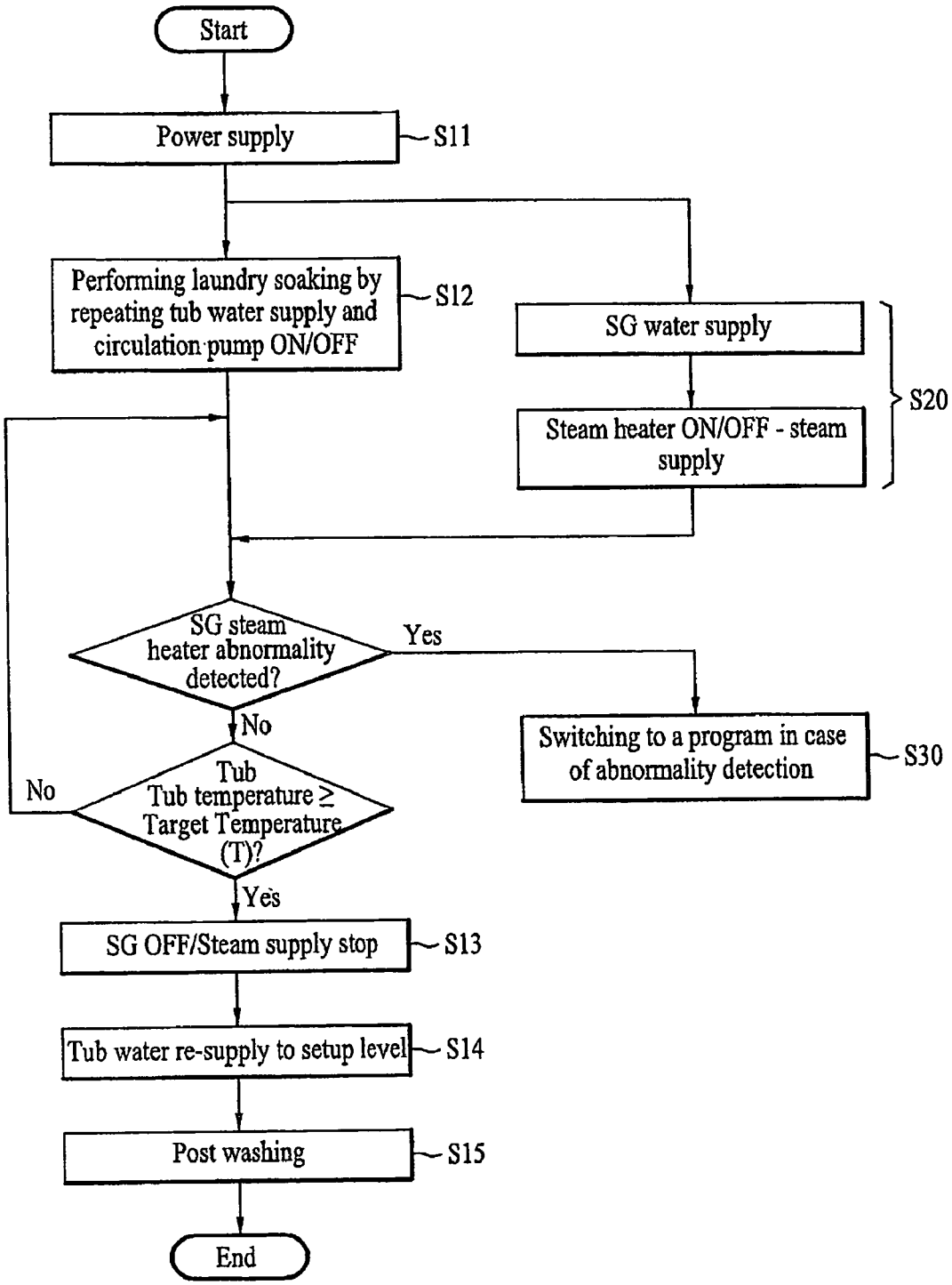
FIG. 8 is a flowchart of a method of operating a washing machine according to another embodiment of the present invention.

FIG. 8 schematically shows an overall process of a washing method according to the present embodiment. The washing method differs from the former washing method shown in FIG. 6 in detecting a presence or non-presence of abnormality of water supply to a steam generator instead of detecting abnormality of the steam generator.

Figure 9:
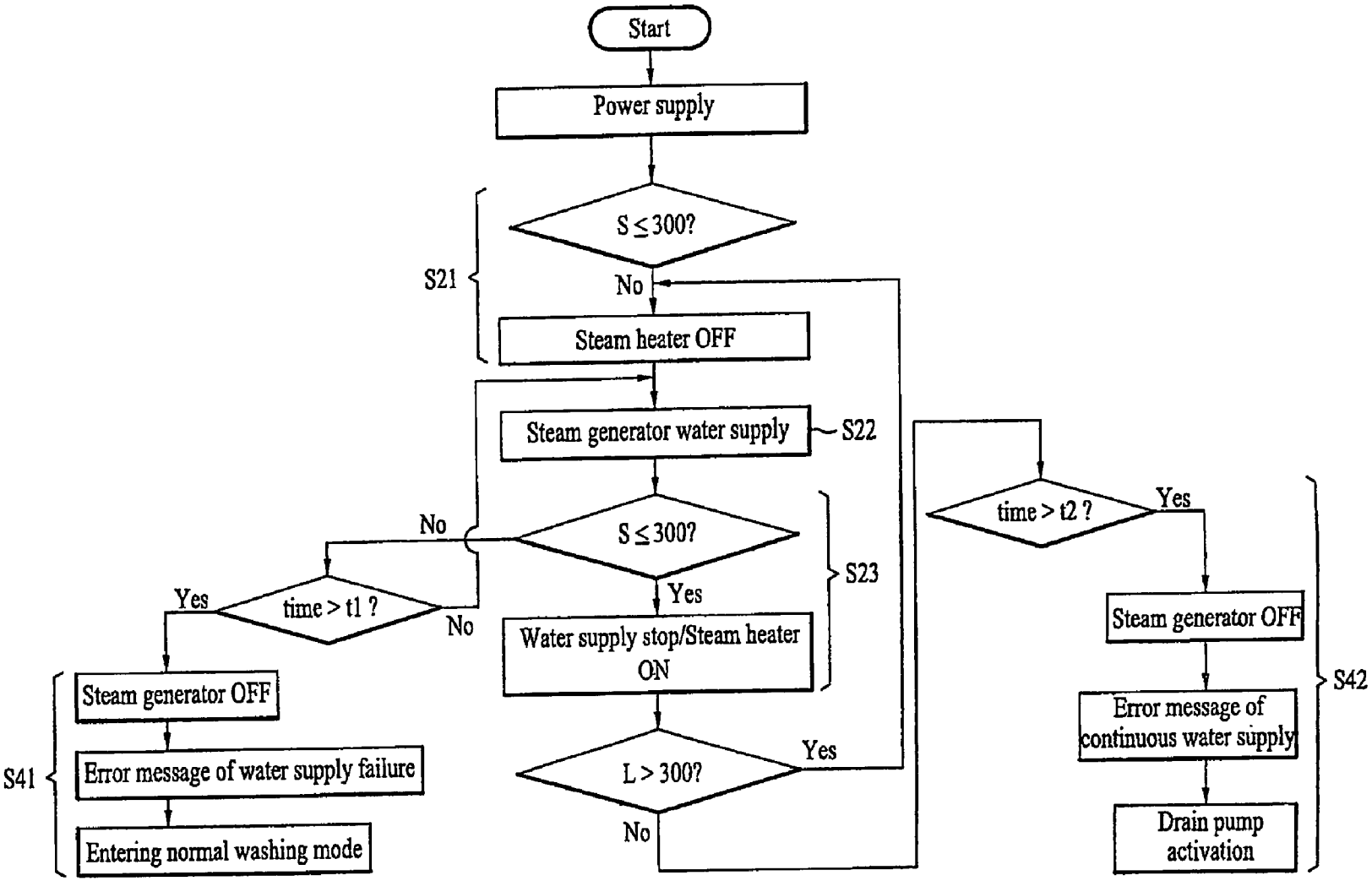
FIG. 9 is a flowchart of a method of detecting abnormality of water supply in the method of operating the washing machine in FIG. 8.

FIG. 9 shows a washing method of performing a washing by detecting a water supply abnormality of this steam generator (SG) 210 according to one embodiment.

Referring to FIG. 9, if a conversion value (S) of the short electrode 218 is greater than 300 by supplying a power, water is supplied to the steam generator 210 while a power is not applied to the steam heater 213 (S21, S22).

Subsequently, if the conversion value (S) of the short electrode 218 becomes equal to or smaller than 300, i.e., if a full water level is detected, the water supply is stopped and steam is supplied by supplying the power to the steam heater 213 to generate heat from the steam heater 213 (S23).

Thus, once the steam is generated by heating the water in the steam generator 210, a level of the water is gradually lowered. So, if a conversion value (L) of the long electrode 217 becomes greater than 300 due to the lowered water level within the steam generator 210, an empty water level is detected. The power of the steam heater 213 of the steam generator 210 is cut off (S21) and water is supplied into the steam generator 210 by turning on the steam water supply valve 182 again (S22).

The steam generator 210 keeps supplying the steam into the drum 130 by repeating the above steps.

Meanwhile, if the short electrode 218 still fails to detect the full water level in the course of supplying the steam from the steam generator 210 after a predetermined time (t1) passes after initiating the water supply to the steam generator 210, i.e., if it is detected that S is greater than 300 after the predetermined time (t1) from a water supply initiation timing point, it is decided that the water supply is not performed due to the steam water supply 182 that is blocked. So, an operation of the steam generator 210 according to one of programs for abnormality detection is stopped and a normal washing mode is entered to carry out a washing process (S41).

Of course in this case, it is preferable that a water supply error message is delivered to a user via a display unit (not shown in the drawing) of the washing machine, a warning sound generation or the like.

In the course of supplying the steam from the steam generator 210, if the long electrode 217 still fails to detect an empty water level after a predetermined time (t2) passes from a timing point of stopping the water supply and initiating to generate heat from the steam heater 213, i.e., if it is detected that L is equal to or lower than 300 after the predetermined time (t2) from a timing point of supplying a power to the steam heater 213, it is decided that the water keeps being supplied into the steam generator 210 as the steam water supply valve 182 keeps being turned on. So, a process of cutting off a power supply to the steam heater 213, delivering a water supply error message and discharging water from the tub by activating the drain pump is carried out according to one of the programs for abnormality detection (S42).

The normal washing mode, which is entered in case of occurrence of the water supply abnormality, is a process for performing a washing cycle without supplying steam into the drum 130 like the washing cycle conducted by the conventional washing machine. For instance, like the aforesaid post-washing, laundry is washed in a manner of supplying water up to the setup level within the tub 120 and rotating the drum 130 clockwise and counterclockwise. In this case, it is preferable that the water is heated up to a prescribed temperature to perform the washing using the water heater 122.

A method of operating a washing machine according to a further embodiment of the present invention is explained in detail with reference to the attached drawings as follows.

Unlike the aforesaid embodiments of the present invention, the present embodiment is characterized in that abnormality of a washing machine corresponds to abnormality of a circulation system that supplies water to a drum by circulating the water of a tub in particular. A configuration of the washing machine can be identical to that of the former embodiment, of which explanation is skipped in the following description.

Figure 10:
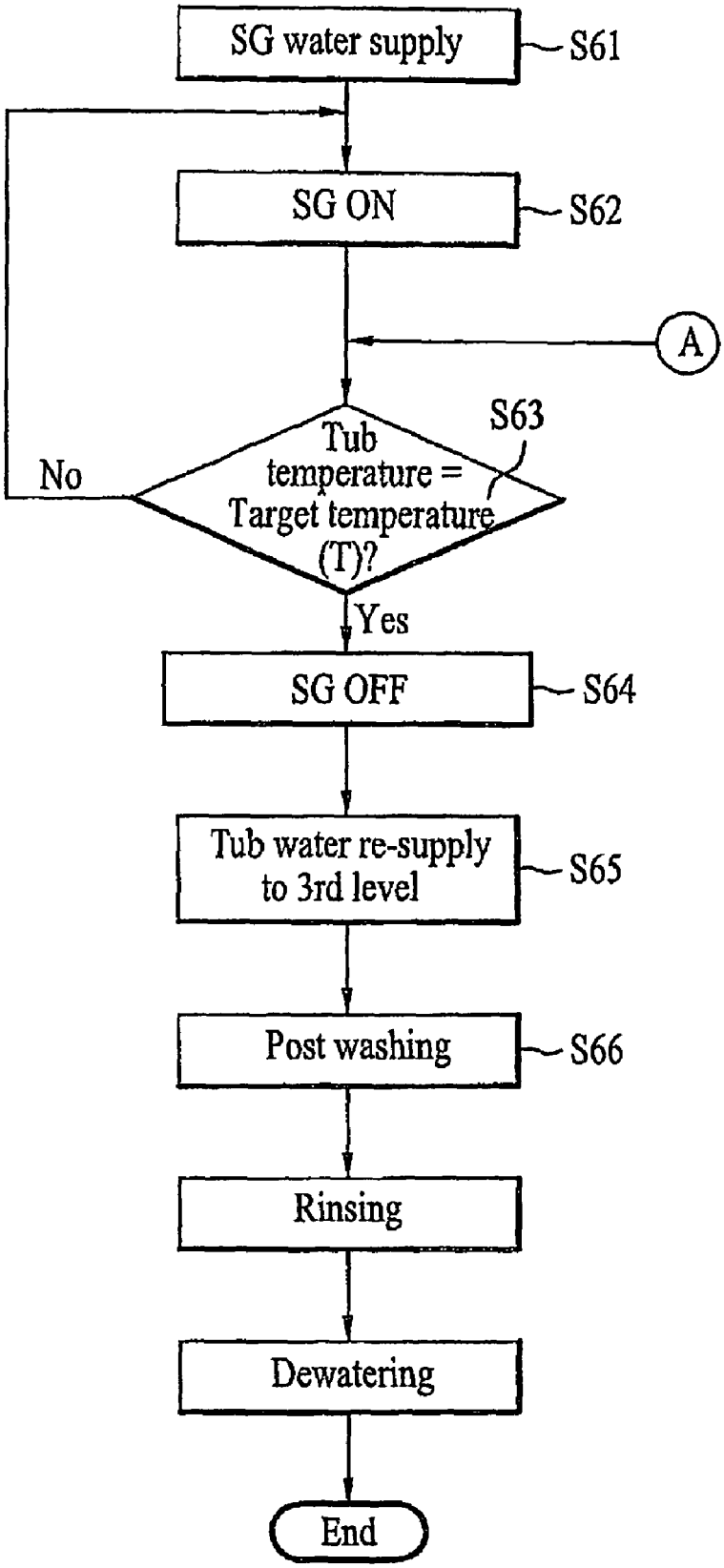
FIG. 10 and FIG. 11 are flowcharts of a method of operating a washing machine according to another embodiment of the present invention.
Figure 11:
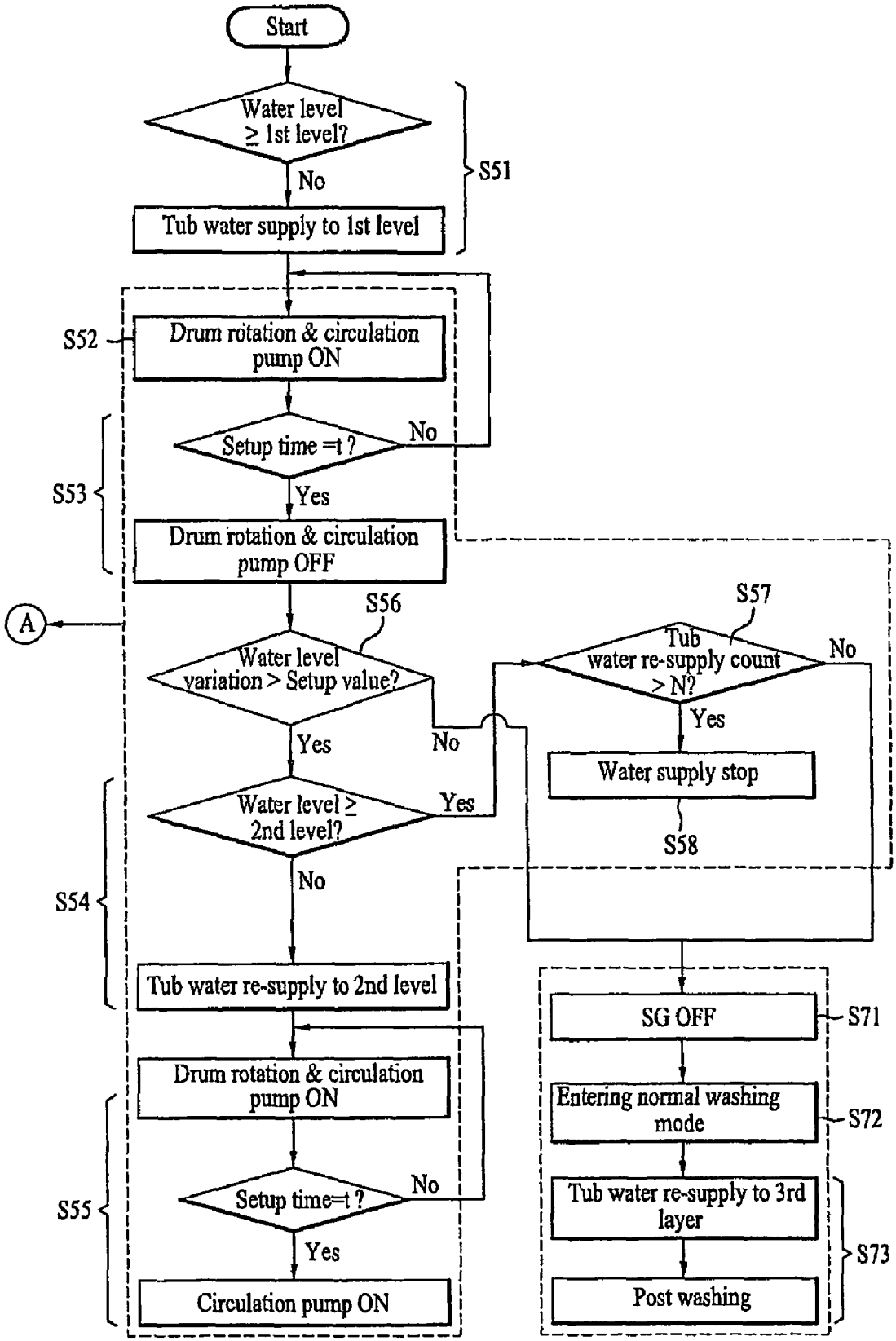

A washing method according to one preferred embodiment of the present invention is explained in detail with reference to flowcharts shown in FIG. 10 and FIG. 11 using the aforesaid configuration of the drum type washing machine as follows.

First of all, if a request for a washing execution is made by a user, the controller (not shown in the drawings) configuring the washing machine controls the water supply valve 181 of the water supply-valve assembly 180 to supply water into the tub 120 (S51).

In this case, the water passes through the detergent box 114 provided on the passage of the water supply pipe 113 in the curse of being supplied via the water supply pipe 113.

Since a prescribed quantity of a detergent is accommodated in the detergent box 114, the detergent stored in the detergent box 114 comes into being contained in the water supplied into the tub 120.

In this case, it is preferable that a level of the supplied water is set enough for a surface of a lower side of the drum 130 to be approximately dipped into the water, i.e., to a level ('first water level') enough to soak the laundry within the drum 130.

Meanwhile, while the water is supplied to the tub 120, a prescribed quantity of water is supplied into the steam generator 210 via the steam water supply valve 182 of the water supply valve assembly (S61).

After completion of the above-mentioned water supply process, the drum 130 is driven to perform the washing using the supplied water in a highly concentrated state. Simultaneously, the circulation pump 160 is driven to enable the water collected on a lower side of the tub 120 to be circulated via an upper part of the drum 130 via the circulation passage 170, whereby the laundry within the drum can be evenly soaked. Namely, a laundry soaking is carried out by the circulation pump 160 (S52).

While the laundry soaking is carried out, the steam heater (not shown in the drawing) of the steam generator 210 is driven to spray steam into the tub 120 and/or the drum 130 via the steam supply pipe 220 and the spray nozzle 230 (S62).

Meanwhile, since the laundry within the tub absorbs the water therein while the laundry soaking is carried out by the circulation pump 160, the water level within the tub is gradually lowered. So, if the laundry soaking by the circulation pump 160 is performed during a predetermined time (t), a rotation of the drum 130 is stopped as soon as an operation of the circulation pump 160 is stopped (S53). And, the water level sensor (not shown in the drawing) detects the water within the tub.

In this case, the steam supply via the steam supply part keeps progressing.

If the water level within the tub 120 is lower than a preset second water level, water re-supply is carried out on the tub 120 up to the second water level by a control of the water supply valve assembly 180 (S54). And, the laundry soaking is carried out by a water circulation in a manner of rotating the drum 130 clockwise and counterclockwise and driving the circulation pump 160 (S55).

Subsequently, water re-supply is repeated via the tub 120 and the drum 130 and the circulation pump 130 are periodically turned on and off, whereby the laundry soaking is achieved several times. Generally, a count of water re-supply into the tub in a normal status corresponds to at least five times but can vary according to such a factor as a washing machine capacity, a laundry quantity and the like.

Meanwhile, while the laundry soaking according to the water re-supply into the tub, the drum rotation and the activated circulation pump 160 is in progress, an internal ambience of the drum 130 is controlled to achieve a temperature most effective in washing performance by spraying the high-temperature steam into the drum 130 via the steam supply part continuously or intermittently.

Namely, a washing effect can be enhanced by achieving a temperature (about 40° C.~60° C.) to provide a most efficient washing performance by activation of the detergent to the drum.

Thus, while the water is re-supplied into the tub 120 several times and while the laundry soaking is performed by the circulation pump 160 and the rotated drum 130, if a temperature sensed by the temperature sensor 150 within the tub 120 reaches a prescribed target temperature (T) (e.g., 40° C.~60° C.) (S63), the steam supply via the steam generator is stopped (S64) and water is supplied into the tub up to a third water level (S65).

Subsequently, the drum 130 is rotated clockwise and counterclockwise to perform a post-washing by a setup program (S66). In the course of performing the post-washing, the washing can be carried out by heating the water within the tub 120 at a prescribed temperature using the water heater 122. And, as mentioned in the foregoing description, the washing can be performed by circulating the water by driving the circulation pump 160 periodically.

After completion of the post-washing, a selected cycle such as a rinsing cycle, a dewatering cycle and the like is carried out in sequence.

Meanwhile, in the washing machine according to the present invention, while the laundry soaking is carried out using the circulation pump 160 by supplying the steam into the drum, if the water circulation is not normally performed due to abnormality of a circulation system due to the abnormality occurrence of the circulation pump 160, the blocking of the circulation passage 170 and the like, the laundry is prevented from being damaged by stopping the steam supply via the steam generating part and by entering a normal washing mode.

Namely, the circulation 160 is stopped after having been driven during a predetermined time (t). A water level variation is measured by the water level sensor (not shown in the drawing) (S56). If the measured water level variation becomes equal to or smaller than a preset value, it is decided that abnormality occurs in the circulation system including the circulation pump 160. So, the steam generator 210 of the steam generating unit stops being driven and the steam supply into the drum is stopped (S71). A normal washing mode is entered (S72). Water re-supply is carried out on the tub 120 up to a third water level. A post washing is then carried out (S73).

Thus, the circulation system abnormality is decided according to the water level variation after the activation of the circulation pump 160. If the abnormality occurs in the circulation system including the circulation pump 160, the laundry soaking cannot be achieved since the water is not circulated. So, the level variation of the water within the tub barely takes place.

Of course, in the present embodiment, the circulation system abnormality is decided by detecting the water level variation after the rotation of the drum 130 and the power supply to the circulation pump 160 have been stopped. So, the water level measurement can be achieved more accurately. Alternatively, while the circulation pimp 160 is being driven, i.e., while the power keeps being supplied to the circulation pump 160, the circulation system abnormality can be decided by a water level variation during a predetermined time.

And, a reference setup value for detecting the circulation system abnormality according to the water level variation is preferably set different according to a laundry quantity.

Moreover, if a count of water re-supply to the tub 120 is equal to or smaller than a preset count, it is decided that abnormality occurs in the circulation system. So, the steam supply is stopped and the normal washing mode can be entered.

In particular, after the circulation pump 160 has been stopped, if the measured water level within the tub becomes equal to or greater than the second water level, a tub water re-supply count is checked (S57) and the water supply is stopped (S58). In this case, if the tub water re-supply count becomes equal to or smaller than a setup count (e.g., 5), it is decided that the water is not circulated. So, it is decided as the circulation system abnormality. If a very small quantity of water circulation takes place due to the abnormality occurrence of the circulation system, the water re-supply is carried out while the laundry soaking is insufficiently performed on the laundry. So, the setup water level can be immediately reached with the water re-supply carried out two or three times only.

If the water re-supply count becomes equal to or greater than the setup count, it is preferable that the normal washing mode is entered by stopping the water supply to the steam generator 210 and the activation of the steam heater (not shown in the drawing) simultaneously.

The normal washing mode is a process of performing a washing cycle without supplying steam into the drum 130 like the washing cycle performed by the conventional washing machine. For instance, like the aforesaid post washing, the laundry is washed by supplying the water into the tub 120 up to the third water level and by rotating the drum 130 clockwise and counterclockwise. If is a matter of course that the washing can be performed in a manner of heating the water at a prescribed temperature using the water heater 122. Yet, since there exists the abnormality in the circulation system, the water circulation using the circulation pump 160 is not carried out.

INDUSTRIAL APPLICABILITY

Included in the detailed description of the invention.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

The invention claimed is:

1. A method of operating a laundry machine, comprising:

(a) supplying water to a steam generator to perform a steam washing mode which uses steam;

(b) supplying steam into a drum by generating heat from a heater of the steam generator; and (c) detecting an abnormal operation of the laundry machine while the step (a) or (b) is carried out, the step (c) including detecting the abnormal supply of water to the steam generator;

(d) stopping a power supply to the steam generator whereupon the abnormal operation of the laundry machine is detected; and (f) switching from the steam washing mode to a normal washing mode which does not use the steam generator and programmed previously for the abnormality detection whereupon the abnormal operation of the laundry machine is detected, and performing the normal washing mode without deactivating the laundry machine, after step (d), wherein the normal washing mode further comprises heating the water using a water heater instead of the steam generator until an internal temperature of the tub reaches a predetermined temperature.

2. The method of claim 1, wherein the step (c) includes detecting an abnormal operation of the steam generator.

3. The method of claim 2, wherein the abnormal operation of the steam generator is a heat generation failure or an overheating of the heater.

4. The method of claim 3, wherein the heat generation failure of the heater is detected whereupon a temperature variation within a tub or the drum during a predetermined time period is equal to or smaller than a predetermined value.

5. The method of claim 3, wherein an overheating of the heater is detected whereupon an internal temperature of the steam generator is equal to or greater than a predetermined value.

6. The method of claim 2, wherein the abnormal operation of the steam generator is an abnormal operation of a temperature sensor sensing an internal temperature of the steam generator.

7. The method of claim 6, wherein the abnormal operation of the temperature sensor is detected whereupon a temperature variation within the tub or the drum for a predetermined time period exceeds a first predetermined value and a temperature variation within the steam generator is equal to or smaller than a second predetermined value.

8. The method of claim 1, wherein the abnormal supply of the water to the steam generator is detected by a water level variation in the steam generator.

9. The method of claim 8, wherein the abnormal supply of the water to the steam generator is a shortage of the water supply to the steam generator or an excess of the water supply to the steam generator.

10. The method of claim 9, wherein the shortage of the water supply is detected whereupon the water level in the steam generator is not equal to or greater than a first water level after a predetermined time period.

11. The method of claim 9, wherein the excess water supply is detected whereupon the water level in the steam generator is not equal to or smaller than a second water level after a predetermined time period.

12. The method of claim 1, further comprising: (e) supplying water into a tub and circulating the water into the drum using a circulation pump.

13. The method of claim 12, wherein the step (d) is carried out while the step (a) or (b) is carried out.

14. The method of claim 13, wherein the step (c) is a step of detecting an abnormal circulation of water.

15. The method of claim 14, wherein the abnormal circulation of water is detected whereupon a water level variation within the tub for a predetermined time period is equal to or smaller than a predetermined value.

16. The method of claim 1, wherein the normal washing mode comprises supplying the water into a tub up to a predetermined level; and rotating the drum clockwise and counterclockwise for a predetermined time period.

17. The method of claim 16, wherein the normal washing mode further comprises: heating the water using a water heater until an internal temperature of the tub reaches a predetermined temperature.

18. The method of claim 3, further comprises supplying water to the steam generator to cool the heater in case that the heat generation failure or the overheating of the heater is detected.

19. The method of claim 1, wherein step d) comprises stopping the water supply to the steam generator.

20. A method of operating a laundry machine, comprising:

(a) supplying water to a steam generator to perform a steam washing mode which uses steam;

(b) supplying steam into a drum by generating heat from a heater of the steam generator; and (c) detecting an abnormal operation of the steam generator, including detecting the abnormal supply of water to the steam generator;

(d) stopping a power supply to the steam generator whereupon the abnormal operation of the steam generator is detected and stopping the steam supply until an internal temperature of the tub reaches a predetermined temperature whereupon the abnormal operating of the laundry machine is not detected; and (f) switching from the steam washing mode to a normal washing mode which does not use the steam generator and programmed previously for the abnormality detection whereupon the abnormal operation of the laundry machine is detected, and performing the normal washing mode without deactivating the laundry machine, after step (d), wherein the normal washing mode further comprises heating the water using a water heater instead of the steam generator until the internal temperature of the tub reaches a predetermined temperature.

* * * * *